United States Patent [19]

Gomi et al.

[11] Patent Number: 4,579,468

[45] Date of Patent: Apr. 1, 1986

[54] WIRE DOT PRINTER UTILIZING MULTICOLOR INKS

[75] Inventors: Yoshifumi Gomi; Yoshinori Miyazawa; Yoshito Ikeda; Yasuhito Hirashima, all of Shiojiri, Japan

[73] Assignee: Epson Corporation, Tokyo, Japan

[21] Appl. No.: 780,230

[22] Filed: Sep. 24, 1985

Related U.S. Application Data

[63] Continuation of Ser. No. 494,583, May 13, 1983, abandoned.

[30] Foreign Application Priority Data

| | | | |
|---|---|---|---|
| May 18, 1982 | [JP] | Japan | 57-83771 |
| May 18, 1982 | [JP] | Japan | 57-83772 |
| May 24, 1982 | [JP] | Japan | 57-87805 |
| May 24, 1982 | [JP] | Japan | 57-87806 |

[51] Int. Cl.[4] ..... B41J 3/12; B41J 27/00; B41J 27/20

[52] U.S. Cl. ..... 400/124; 400/470; 400/702.1

[58] Field of Search ..... 400/124, 470–471.1, 400/701, 702, 702.1; 101/93.04, 93.05

[56] References Cited

U.S. PATENT DOCUMENTS

| | | | |
|---|---|---|---|
| 4,194,846 | 3/1980 | Zerillo | 400/124 |
| 4,400,102 | 8/1983 | Shiurila et al. | 400/124 |

FOREIGN PATENT DOCUMENTS

| | | | |
|---|---|---|---|
| 42293 | 12/1981 | European Pat. Off. | 400/470 |
| 867997 | 2/1953 | Fed. Rep. of Germany | 400/702 |
| 61490 | 5/1980 | Japan | 400/701 |
| 33972 | 4/1981 | Japan | 400/144.2 |

*Primary Examiner*—Paul T. Sewell

*Attorney, Agent, or Firm*—Blum Kaplan Friedman Silberman & Beran

[57] ABSTRACT

A wire dot printer having a plurality of ink applicators for separately applying inks of different colors to the ends of printing wires disposed in separate groups in the ink applicators. The ink applicators are supplied respectively with inks of different colors for effecting multicolor printing on a recording paper. The wire groups are separately housed in a plurality of compartments extending longitudinally of the wires and are separated by partitions. The ends of the wires in each group are arranged in an array. The printer may include a cleaning mechanism for removing deposited paper dust and ink from the distal end of the print head while preventing mixing of ink colors.

27 Claims, 22 Drawing Figures

FIG. 3
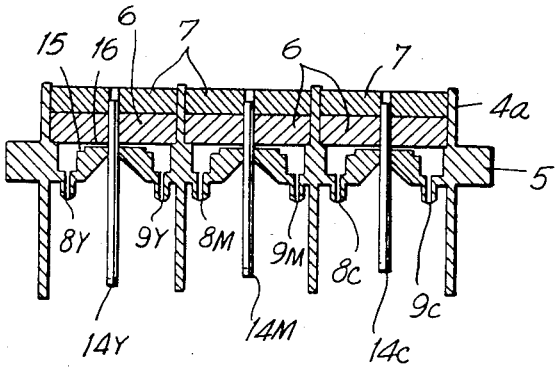
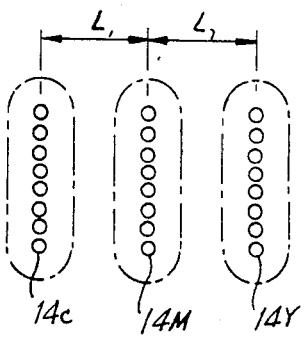
FIG. 13
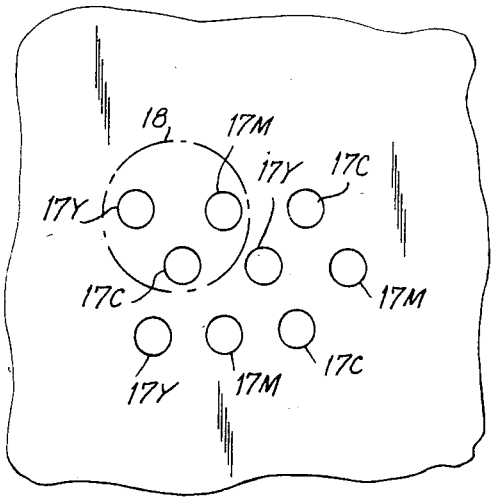
FIG. 14

FIG. 19
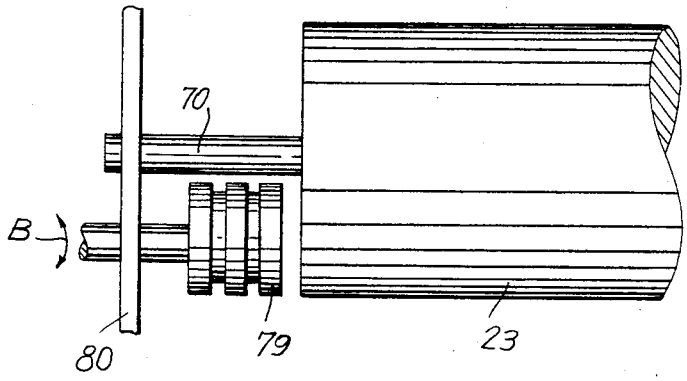
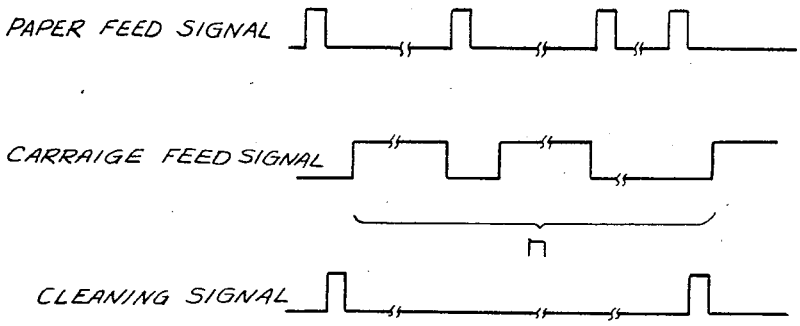
FIG. 20

WIRE DOT PRINTER UTILIZING MULTICOLOR INKS

This is a continuation of application Ser. No. 494,583, filed May 13, 1983, abandoned.

BACKGROUND OF THE INVENTION

The present invention is directed to a wire dot printer, and, in particular, to a wire dot printer having a matrix of wire ends for carrying inks of different colors to effect multicolor printing on a recording medium such as paper.

For printing in different colors, an impact color printer has been proposed and put into use which employs a ribbon having strips which are differently colored either longitudinally or transversely. This type of impact color printer can print characters in only one color while the print head thereof is scanning the paper in a single scanning stroke. When it is necessary to print different colors on a single line, the print head is required to scan the same line in as many strokes as there are colors to be printed, resulting in a greatly reduced printing speed. The service life of the overall ribbon is governed by that of the color strip thereof which is most frequently used. With the prior art impact color printer, more colors than colors available on the ribbon can be printed by printing a number of juxtaposed colors on the same dot. However, the ink previously printed on the dot tends to be transferred to ribbon strips of other colors, with the result that inks of different colors will be mixed together on the ribbon as the ribbon is frequently used.

Two of the inventors of the present application together with two other inventors have proposed, in copending application Ser. No. 274,322 filed June 16, 1981, now U.S. Pat. No. 4,456,393, issued June 26, 1984 and entitled "Wire Dot Printer" incorporated herein by reference as though fully set forth, a wire dot printer having a matrix of wire ends for carrying ink to effect printing. The wire dot printer disclosed in that application is capable of supplying an appropriate amount of ink to the wire ends for performing stable printing of high quality. The present invention has been made and developed in connection with the invention disclosed in the above referred to copending application but provides a wire dot printer capable of multicolor printing.

The wire dot printer disclosed in the prior copending application employes two tubes for supplying ink to a print head and for collecting excess ink. To convert that type of wire dot printer into a color printer which utilizes three differently colored inks, a total of six ink supply and collection tubes would be required to connect the respective ink tanks for the three inks to a print head, the tubes being coupled to predetermined portions of the print head. Accordingly, such a color printer would be cumbersome and difficult to assemble.

It is important in wire dot printers utilizing multicolor inks or inks of different colors that provision be made for preventing the inks from being mixed together with each other. To this end, the interior of the print head should have ink passages formed for respective colored inks in a limited space without causing color mixing. Therefore, such a print head is liable to be complex in structure, cumbersome to put together, and less reliable in operation.

With the wire dot printer of the prior copending application, the continued printing operation may result in a deposit of paper dust from the recording paper and ink being spattered from the paper on the end of the print head. As a result, the recording paper tends to become smeared by the deposit of ink and paper dust on the print head. The deposited paper dust may find its way into the ink passage tubes to thereby interfere with proper supply and collection of ink. For color printing with inks of various colors, the deposited paper dust may give rise to capillary attraction causing the inks to become mixed together. The printed characters would thus be of mixed colors, and no proper color printing could be accomplished. Accordingly, it is desired to provide an improved wire dot printer which can print in different colored inks while avoiding the problems described above.

SUMMARY OF THE INVENTION

Generally speaking, in accordance with the present invention, a wire dot printer capable of printing with different colors of ink to effect multicolor printing, is provided. The wire dot printer includes a plurality of wires which carry the different ink colors on the ends thereof. A plurality of ink applicator mechanisms house the wires in separate groups. Each group of wires supply a separate color of ink for printing. An ink supply mechanism supplies the different colors of ink to the ink applicator mechanisms which, in turn, supply the different colors of ink respectively to each group of wires to permit multicolor printing.

In accordance with the present invention, there is provided a wire dot printer in which inks of a plurality of colors such as the three colors of cyan, yellow and magneta, or those color inks plus a black ink, are supplied to the ends of a plurality of wires which are selectively projected to control the density of printed dots in these colors, or to superimpose dots of different colors for printing various other colors. The wire dot printer in which the inks of different colors are applied to the ends of the wires for multicolor printing includes a plurality of ink applicator mechanisms which divide the wires into groups which are respectively disposed for supplying the differently-colored inks to the ink applicator mechanisms. The groups of wires which correspond respectively to the different ink colors are arranged in arrays on the printing end of a print head. A guide block on the print head includes a plurality of compartments divided by partitions, each wire group being separately disposed in a compartment.

The wire dot printer of the present invention also includes a tube connector connected to ink tubes extending from an ink supply mechanism and slidably mounted on a carriage on which the print head is mounted. An ink supply guide includes a coupling which is connectable to the tube connector.

Further according to the present invention, the wire dot printer may include a cleaning member having an outer peripheral configuration with projections capable of contacting the distal end of the print head and alternate recesses kept out of contact with the distal end of the print head. The cleaning member is rotatable for cleaning the distal end of the print head by means of the projections thereon.

The cleaning member is composed of as many cleaning portions as there are colors of inks to be used, with partitions interposed between each cleaning portion to prevent mixing of the cleaned ink and paper dust. The cleaning member may comprise divided cleaning member pieces for easy attachment and removal.

Accordingly, it is an object of the present invention to provide an improved wire dot printer which can print with different colors of ink to effect multicolor printing.

A further object of the present invention is to provide a multicolor wire dot printer capable of high-speed multicolor printing without color mixing which can supply inks of different colors independently to separate groups of wires.

Another object of the present invention is to provide a multicolor wire dot printer having a print head which can be assembled easily.

Still another object of the present invention is to provide a multicolor wire dot printer having a print head which is reliable in operation.

A still further object of the present invention is to provide a multicolor wire dot printer having a simple cleaning mechanism for removing deposits of paper dust and ink off the distal end of a print head to allow the print head to effect proper color printing.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 3 is a cross-sectional view of an ink applicator mechanism at the distal end of the print head in the wire dot printer depicted in FIG. 1;

FIG. 13 is a front elevational view showing a matrix of wire ends at the distal end of the print head;

FIG. 14 is a diagram illustrative of printed dots on a recording medium;

FIG. 19 is a fragmentary plan view of a cleaning device according to another embodiment of the present invention; and, FIG. 20 is a timing chart of operation of the cleaning device of the present invention.

DESCRIPTION OF THE PREFERRED EMBODIMENTS

Figure 1:
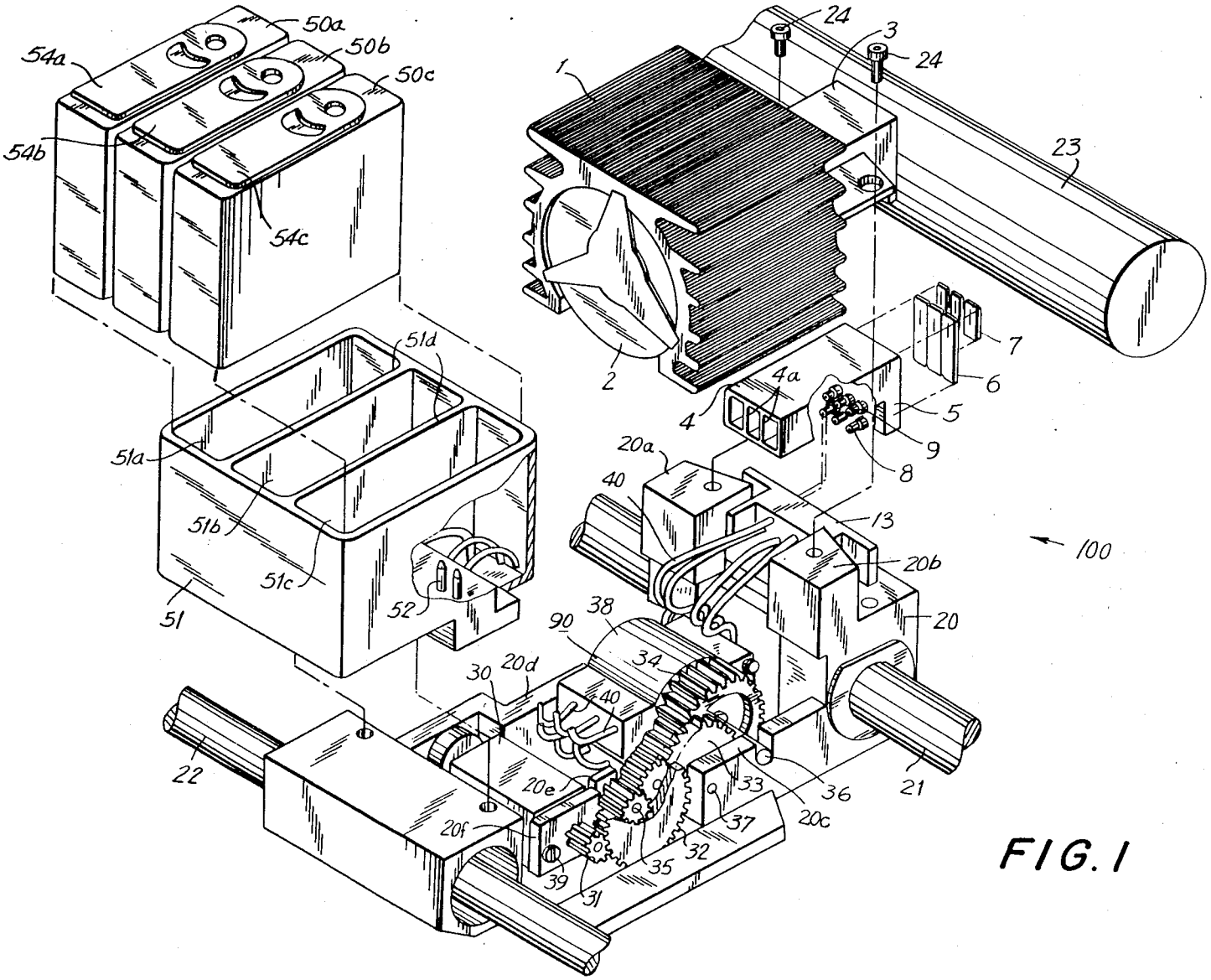
FIG. 1 is an exploded perspective view of a wire dot printer utilizing inks of different colors to effect multicolor printing in accordance with a first embodiment of the present invention.

Reference is first made to FIG. 1 which depicts a carriage 20 and surrounding parts in a wire dot printer, generally indicated at 100, utilizing multicolor inks or inks of different colors according to an embodiment of the present invention. Carriage 20 supports thereon ink tanks 50*a*, 50*b*, 50*c* which contain inks of three colors, for example, cyan, yellow and magenta, respectively, a pump 90, and a print head 1. Carriage 20 is movable transversely across a sheet of recording paper. Print head 1 includes a nose 3 housing a total of twenty-four (24) wires and a driver 2 for selectively projecting the wires toward the sheet of recording paper. Print head 1 is secured to carriage 20 by screws 24.

The wires are guided by and supplied with inks from a guide block 4 having an ink supply and discharge guide 5 to which a tube connector 13 is coupled. Coupled to tube connector 13 are a total of six ink supply and collection tubes 40 for the inks, the tubes being connected in pairs through pump 90 to ink tanks 50*a*, 50*b* and 50*c* respectively.

Figure 2:
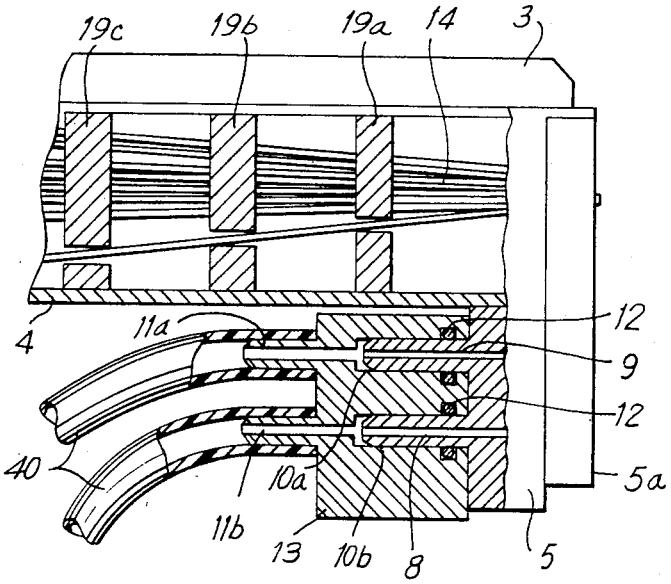
FIG. 2 is a cross-sectional view of a nose of a print head of the wire dot printer depicted in FIG. 1.

FIG. 2 is a cross-sectional view of guide block 4 and tube connector 13. Guide block 4 is in the form of a hollow prism extending longitudinally of the wires, and has two partitions or walls 4*a* (FIG. 1) extending in the longitudinal direction of wires 14 to divide guide block 4 into three compartments. Ink supply and discharge guide 5 is mounted integrally on a front end of guide block 4. As many guide plates 19*a*, 19*b* and 19*c* as required for preventing the wires from buckling are disposed in guide block 4. The wires are inserted from the left (FIG. 2) where driver 2 is located through guide holes in the guide plates and guide holes in ink supply and discharge guide 5 until the wire ends reach the printing end at the right of FIG. 2. An ink application guide 7 and a wire guide 6 (FIG. 1) are mounted on guide block 4 for controlling the amount of ink applied and arranging the wires properly.

Print head 1 according to the present embodiment has 24 wires divided into three groups of eight wires, each group being supplied with an ink of one color. The groups of wires are separated by partitions 4*a* and are each arranged in a vertical array at the printing end. Thus, the 24 wires are positioned at the nose end in three vertical arrays of wire ends separated from each other. The inks are supplied through ink supply holes 8 in a lower portion 5*a* of ink supply and discharge guide 5, and circulate through ink supply and discharge guide 5. Portions of the inks are fed to the wires and consumed thereby for printing, and any excess inks are collected through ink collection holes 9 formed above ink supply holes 8 in the lower portion 5*a* of ink supply and discharge guide 5. Since the wires for each ink color are vertically arrayed, three ink passages may be formed independently of each other in ink application guide 7. During the printing operation, the inks are transferred back along the wires due to reciprocating movement thereof. However, there is no danger that these inks will become mixed together as the compartments in the guide block 4 are separated by partitions 4*a*.

FIG. 3 shows in cross-section an ink applicator mechanism at the distal end of print head 1 shown in FIG. 1. The ink applicator mechanism includes ink supply and discharge guide 5, wire guide 6 and the ink application 7. The ink applicator mechanism is composed of three ink applicator mechanisms juxtaposed laterally, with each ink applicator mechanism being constructed basically as that disclosed in copending application Ser. No. 274,322 discussed above.

Hereinafter, to aid in explanation, the inks having the colors of yellow, magenta and cyan will be represented by the letters Y, M and C respectively. The inks Y, M and C are passed through ink supply ports 8Y, 8M and 8C, respectively, and through ink passages into ink collection ports 9Y, 9M and 9C, respectively. The ink passages are defined between ink supply and discharge guide 5 and wire guide 6. The wires are arranged as wire arrays 14Y, 14M and 14C in the respective ink applicator mechanisms. The inks are applied to the wire arrays stably by ink application guide 7. More specifically, each ink passage comprises a bypass portion 15 having an increased depth and width for allowing ink to flow easily, and a capillary region 16 defined in a reduced gap between ink supply guide 5 and wire guide 6 for storing ink due to capillary attraction. Thus, ink is drawn from bypass portion 15 into capillary region 16 under capillary attraction. Wire guide 6 and wires 14 are spaced by clearances dimensioned to provide capillary attraction. The inks are fed toward the wire ends and applied thereto under the capillary attraction of capillary region 16 and pumping action when the wires are driven.

Figure 4:
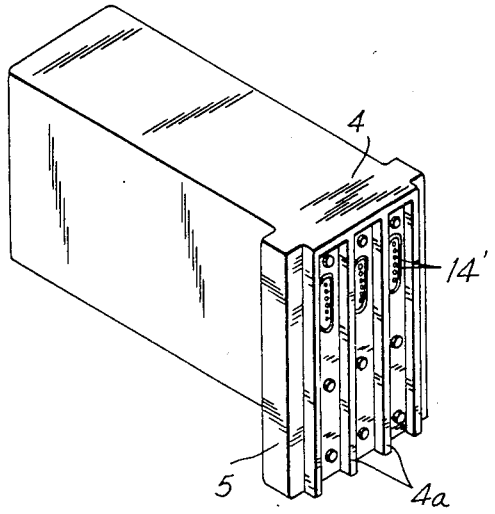
FIG. 4 is a perspective view of a guide block in the wire dot printer depicted in FIG. 1.

FIG. 4 is a perspective view of guide block 4 showing the wire ends 14', with ink application guide 7 and wire guide 6 being removed. As shown, partitions 4*a* extend to the printing end of guide block 4, for preventing ink colors from being mixed together at the printing end beyond ink supply and discharge guide 5 for clear color printing.

Figure 5:
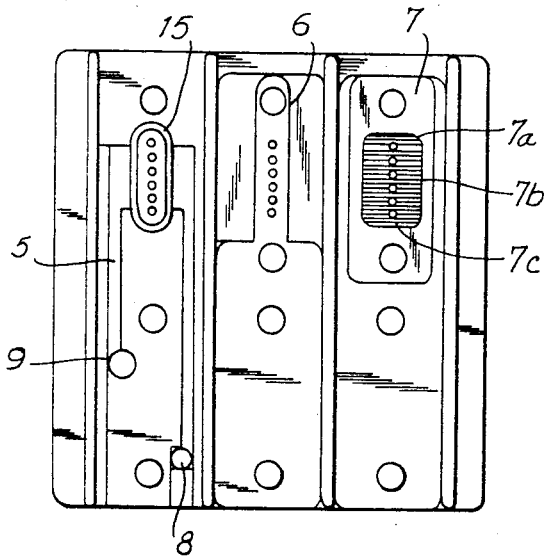
FIG. 5 is a front elevational view of the guide block depicted in FIG. 4 showing various portions removed.

FIG. 5 is a front elevational view of guide block 4 depicted in FIG. 4 illustrating the printing ends of wires 14. Ink application guide 7 is shown mounted on the right hand wire array. Ink application guide 7 is shown removed from the central wire array. Ink application guide 7 and wire guide 6 are shown removed from the left hand wire array to illustrate ink supply and discharge guide 5 only. The inks supplied from the ink supply ports 8 flow into bypass portions 15, then are filled in capillary regions 16, and are finally discharged through ink collection ports 9.

Ink application guide 7 has a plurality of slots 7*b* leading to holes 7*a* for guiding wires 14, and a slot 7*c* connecting wire guide holes 7*a* together for allowing smooth application of ink to wires 14. While the ink applicator mechanism has been described as being composed of separate components, that is, ink supply and discharge guide 5, wire guide 6, and ink application guide 7, wire guide 6 and ink application guide 7 may be integrally formed.

Figure 6:
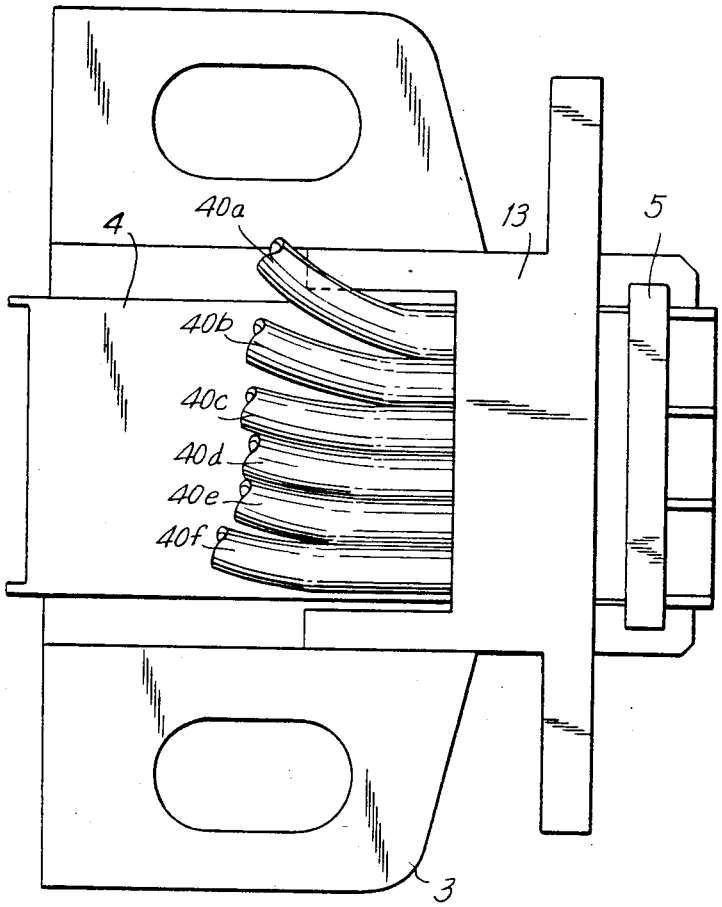
FIG. 6 is a bottom plan view of the nose of the print head depicted in FIG. 1.

FIG. 6 is a bottom view of nose 3 of print head 1, the view showing guide block 4 for guiding the wires and supplying the inks to the wires. Ink supply and discharge guide 5 constitutes part of guide block 4, and tube connector 13 is coupled to ink supply and discharge guide 5. A total of six tubes 40*a* through 40*f* for supplying and discharging the inks of the respective colors are connected to tube connector 13 and to the ink tanks through pump 90.

The manner in which the ink supply and collection tubes are connected to ink supply and discharge guide 5 will now be described with reference to FIGS. 1 and 2. The six tubes 40 extending from ink tanks 50*a*, 50*b* and 50*c* are first connected to projections 11*a* and 11*b*, for example, of tube connector 13. When print head 1 is to be secured to carriage 20, tube connector 13 is slidably set in place between carriage members 20*a* and 20*b*, and print head 1 or tube connector 13 or both are slid to permit six projections, such as projections 8 and 9 to be connected to the corresponding six holes, such as holes 10*a* and 10*b*, for setting print head 1 in position. Thereafter, print head 1 is secured to carriage 20 by screws 24. Accordingly, print head 1 can be secured to carriage 20 with tubes 40 connected to print head 1 quite easily.

In the embodiment of FIG. 2 which shows the nose in vertical cross section, holes 10*a* and 10*b* in tube connector 13 are coupled to projections 8 and 9 of ink supply and discharge guide 5. Tube connector 13 has grooves receiving O-rings 12 therein for preventing ink leakage and allowing more reliable tube connection. O-rings 12 may be received in projections 11a and 11b of ink supply and discharge guide 5 to achieve the same advantages.

The ink tanks and the pump for supplying and discharging the inks will now be described with reference to FIG. 1. Ink tanks 50 are removably mounted in a tank guide 51 fixed to the carriage 20. Hollow needles 52 are disposed in and affixed to tank guide 51 for supplying the inks from the tanks and for collecting and returning the inks into the tanks. As illustrated, ink tanks 50*a*, 50*b* and 50*c* with the inks of three colors, that is, cyan, yellow, and magenta, respectively, are mounted in tank guide 51 for effecting multicolor printing. Tank guide 51 has partitions or walls 51*d* extending to the bottom thereof and defining independent tank insertion compartments 51*a*, 51*b* and 51*c* respectively for ink tanks 50*a*, 50*b* and 50*c*. Hollow needles 52 for supplying and collecting ink are provided in pairs each corresponding to one color and ink tank. With the three colors in this embodiment, a total of six hollow needles are secured to the bottom of tank guide 51, two for each ink tank. Ink tanks 50*a*, 50*b* and 50*c* are inserted respectively in tank insertion compartments 51*a*, 51*b* and 51*c*. When the ink tanks are fully inserted, the hollow needles 52 penetrate resilient diaphragms (not shown) attached to the bottom of the ink tanks for supplying the inks contained in the ink tanks.

Since tank compartments 51*a*, 51*b* and 51*c* are divided independently by the partitions 51*d* extending to the bottom of ink tank 51, there is no risk for the inks of different colors to be mixed together even when there is ink leakage upon attachment or removal of the ink tanks. Therefore, proper multicolor printing can be achieved at all times.

Pump 90 for supplying the inks is in the form of a tube pump driven by a pump motor 30 through a motor pinion 31, intermediate gears 32 and 33, and a pump gear 34. Pump motor 30 is secured to a projection 20*f* of carriage 20 by a screw 39. An intermediate gear shaft 35 is screwed to or mounted by insert molding on a carriage projection 20*e*. Likewise, an intermediate gear shaft 37 and a pump gear shaft 36 are screwed to or mounted by insert molding on carriage projections 20*c* and 20*d*. Tubes 40 which are made of an elastomeric material such as silicone rubber extend from hollow needles 52 projecting into the ink tank 50 through tube pump 90 to pipes 8, 9 of ink supply and discharge guide 5 coupled to the print head 1. Therefore, ink paths are formed from the ink tanks to the tube pump to the print head back to the tube pump and to the ink tanks.

Figure 7:
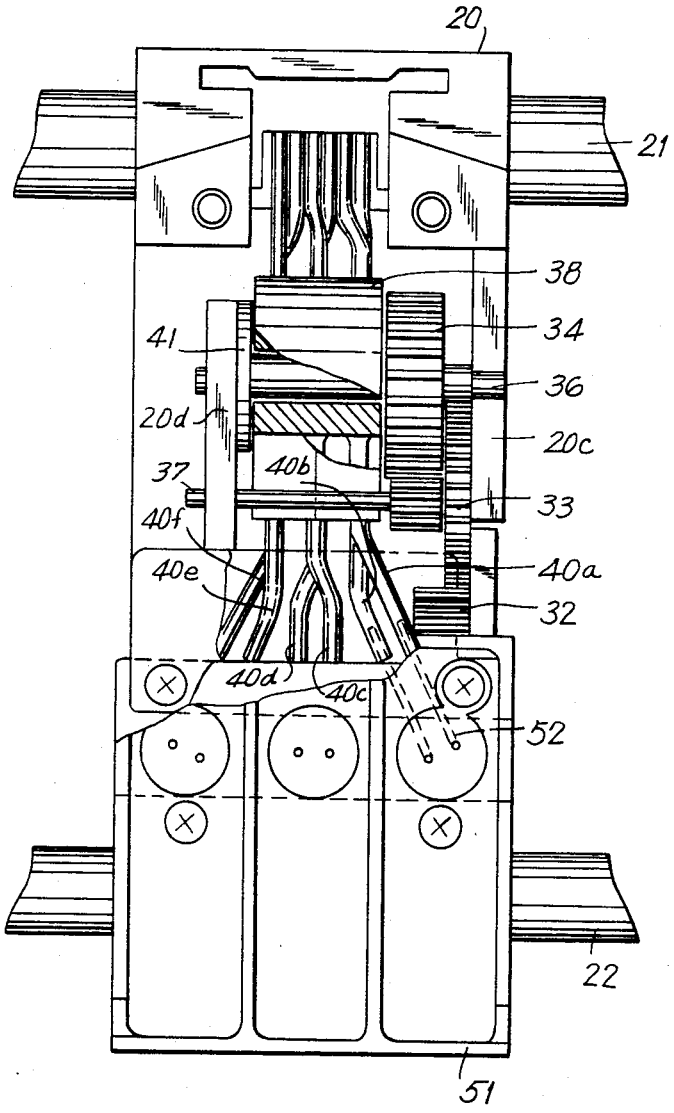
FIG. 7 is an elevational view of a carriage shown with the print head and ink tanks removed.
Figure 8:
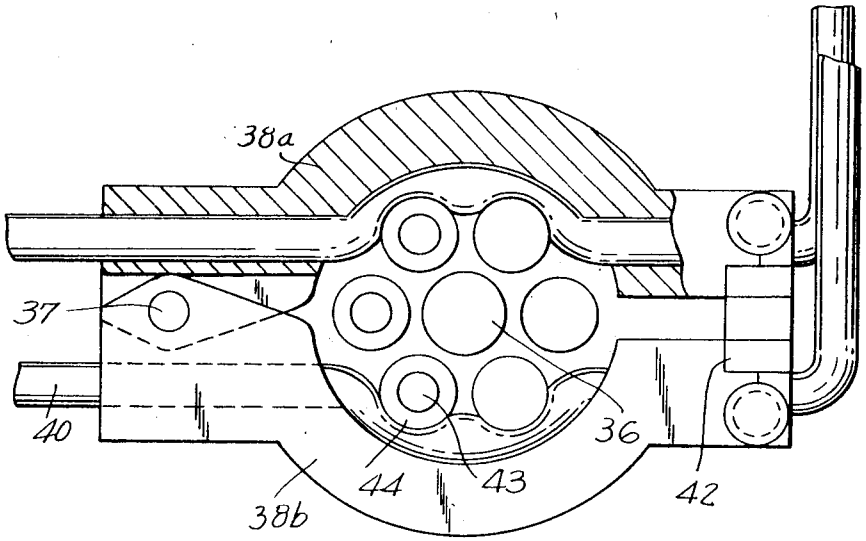
FIG. 8 is a side elevational view of an ink pump.

Pump 90 will now be described in greater detail with reference to FIGS. 7 and 8. Pump 90 has tube presser rollers 44 mounted respectively on roller shafts 43 for pressing tubes 40 and supported on pump gear 34 and a bearing plate 41. Tubes 40 extend through holes in a pump housing 38 which are slightly smaller in diameter than tubes 40 and are fixed therein against withdrawal under frictional forces. Housing 38 includes a pair of housing members 38*a* and 38*b* pivotably mounted on intermediate gear shaft 37 and urged by a spring 42 extending therebetween to press tubes 40. The principles of operation of such a tube pump are well known and need not be described in further detail herein. When pump motor 30 is energized, pump gear 34 is driven to cause tube presser rollers 44 arranged in a circle concentric with pump gear 34 to rotate about roller shafts 43 and also to revolve around pump gear shaft 36. Tube presser rollers 44 as they roll along press tubes 40 against housing members 38*a* and 38*b* to pump the fluids or inks in the tubes.

In the illustrated embodiment, two tubes 40 are provided for supplying and discharging an ink of a single color, and hence a total of six tubes 40*a* through 40*f* are provided for printing in three colors. The tubes are disposed in three adjacent pairs between housing members 38*a* and 38*b*. Pump 90 can thus be of a small size for feeding and discharging the inks of the three colors. While in the depicted embodiment a tube pump has been described, pumps of other types such as a gear pump or a plunger pump may be employed in place of the tube pump.

Figure 9:
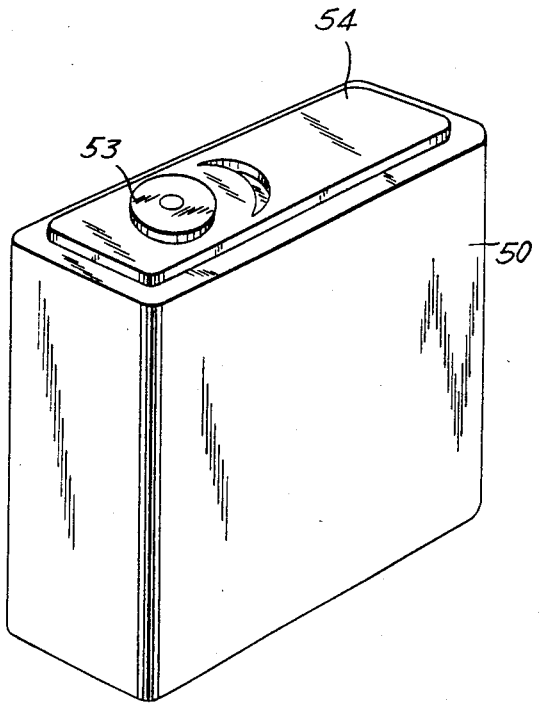
FIG. 9 is a perspective view of an ink tank according to an embodiment of the present invention.

The ink tanks will now be described in greater detail. FIG. 9 is a perspective view of an ink tank 50 according to an embodiment of the present invention. Ink tank 50 includes a grip 54 affixed thereto by means of a grip fastening pin 53.

Figure 10A:
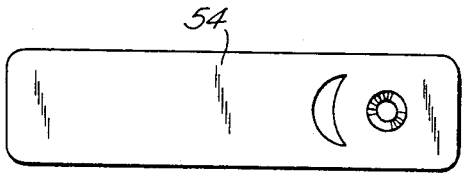
FIGS. 10A and 10B are plan and cross-sectional views respectively of the ink tank handle depicted in FIG. 9.
Figure 10B:
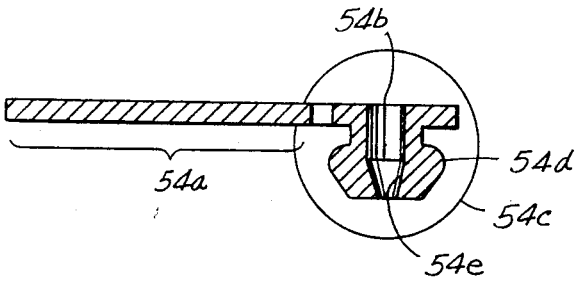

FIGS. 10A and 10B depict grip 54 in plan view and in cross-section, respectively. Grip 54 should preferably be of a flexible resilient material such as rubber. Grip 54 shown in FIGS. 10A and 10B is basically comprised of a grip portion 54*a* to be gripped by hand and an engagement portion 54*c* to be held in engagement with ink tank 50. The engagement portion 54*c* includes a bulb-shaped body 54*d* having a central hole 54*b* extending therethrough and including a conical tapered portion 54*e* at a lower end thereof.

Figure 11:
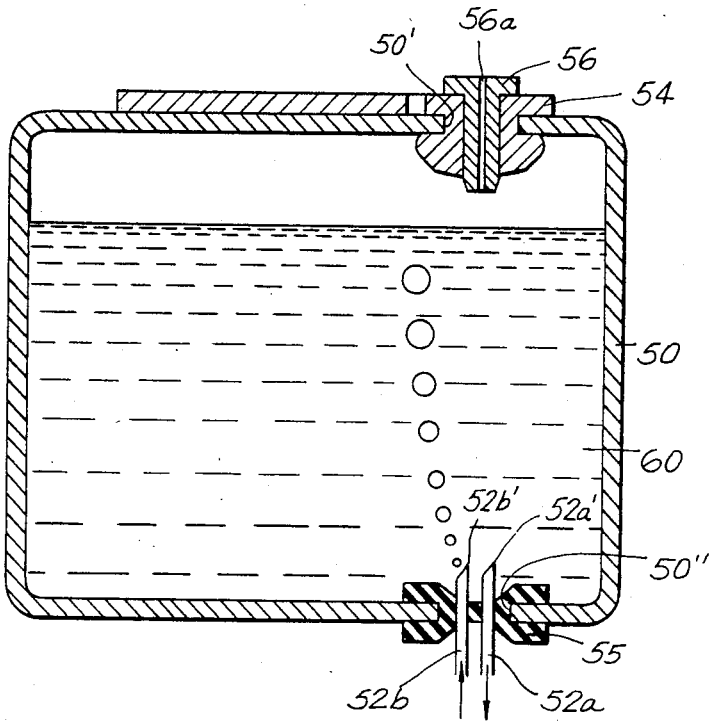
FIG. 11 is a cross-sectional view of the ink tank depicted in FIG. 9.

FIG. 11 depicts grip 54 in cross-section as attached to ink tank 50. Ink tank 50 is made of a plastic material such a polyacetal or nylon, and has an opening 50' in its upper wall for insertion therein of engagement portion 54*c* of grip 54. Ink tank 50 also has an opening 50'' in its lower wall in which is inserted a resilient diaphragm 55 with ink supply needle 52*a* and ink collection needle 52*b* extending therethrough. Ink supply needle 52*a* and ink collection needle 52*b* are mounted on the tank guide and have pointed distal ends 52*a'* and 52*b'*. When the ink tank is set in the tank guide, needles 52*a* and 52*b* penetrate resilient diaphragm 55 on the bottom of the ink tank so that the ink can be supplied from the ink tank or returned to the ink tank. Resilient diaphragm 55 may be formed of rubber, for example, to provide sealing against ink leakage.

Engagement portion 54*c* of grip 54 is pushed into opening 50' in the upper wall of ink tank 50, and a grip fastening pin 56 is inserted into opening 54*b* in engagement portion 54*c*. Since opening 54*b* in the engagement portion 54*c* is tapered as shown in FIG. 10B, the bulb-shaped body 54*d* of engagement portion 54*c* is spread outwardly by pushing pin 56 of a substantially uniform cross section into the opening 54*b*. Therefore, engagement portion 54*c* is secured to the ink tank for protection against being pulled off when plate-shaped grip 54*a* is gripped and pulled up for removing ink tank 50 from the tank guide. Grip fastening pin 56 has a vertical through aperture 56*a* effective to allow air to escape out of ink tank 50.

Figure 12A:
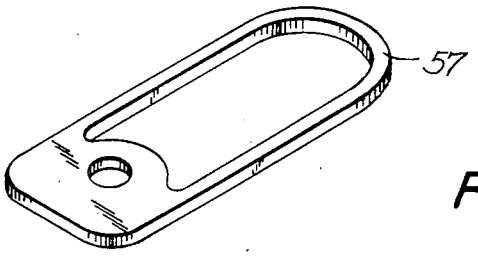
FIGS. 12A and 12B are perspective views of alternative embodiments of handles for ink tanks.
Figure 12B:
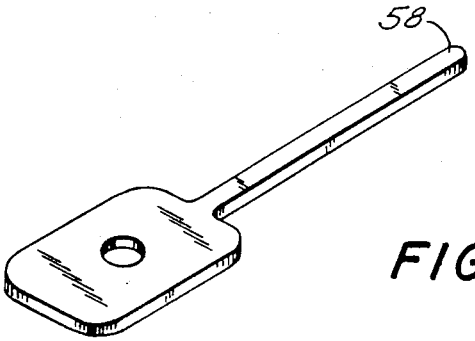

With wire dot printers utilizing ink, the pump has a greater capability of collecting ink from the head than its capability of supplying ink to the head for stabilizing the printing quality. For this reason, ink and excess air are introduced into the ink tank. If the ink tank were sealed off, the pressure within the ink tank would be increased to the point where some damage could occur. Aperture 56*a* in pin 56 for allowing air escape is thus required for preventing this problem. It is noted that the grip may be of a ring shape 57 as shown in FIG. 12A, a rod shape as shown in FIG. 12B, or other simple configurations providing for an easy grip.

With the grip mounted on the ink tank, the ink tank can easily be removed simply by gripping and pulling up on the grip when desired. There is no need to change the dimensions of the contour of the ink tank for such removal. The ink tank can be removed with no space available around the ink tank. Where a plurality of such ink tanks are disposed in juxtaposed relation as illustrated in FIG. 1, it would be quite difficult to hold the ink tanks themselves by hand, but they can readily be detached by gripping the grips thereof according to the present invention. Since a plurality of inks of different colors are utilized in such multicolor printers, it is necessary that the colors of the inks in the ink tanks be identified when the ink tanks are to be attached or replaced. To meet this requirement, grips 54*a*, 54*b* and 54*c* are differently colored in hues corresponding respectively to the inks. By thus coloring the grips in the same colors as those of the inks, the colors used can be identified with utmost ease. With the grips made of rubber, any desired colors may be obtained on the grips by mixing pigments with the rubber. Accordingly, ink tank identification can be accomplished simply and inexpensively.

Another advantage with the present invention is that it is easy to introduce ink into the ink tank. Before the grip is mounted on the ink tank, the relatively large opening remains open in the upper wall of the ink tank, and the ink can be supplied into the ink tank through this opening. After the ink has been filled, the grip is attached and the grip fastening pin is pushed in. Before the grip fastening pin is pushed into the grip, the bulb-shaped body of the engagement portion of the grip is easily deformable, so that the engagement portion can easily be fitted into the ink tank with no danger for the filled ink to be ejected out.

In the wire dot printer of the present invention, the inks Y, M and C are supplied from independent ink tanks through the respective tubes to ink supply and discharge guide 5 on the distal end of print head 1. Excess inks are collected by the ink tanks. The print head of the foregoing construction has the wire arrays respectively for different colors, the wire arrays being regarded as independent print heads. Therefore, the fundamental colors Y, M and C can be simultaneously printed when the print head scans a sheet of recording paper in a single stroke.

FIG. 13 shows an arrangement of wire ends at the distal end of print head 1. The wire arrays 14Y, 14M and 14C have the same number of wires positioned at the same height. When print head 1 is moved an interval equal to a distance L between adjacent wire arrays, print head 1 is controlled to print dots by the next wire array. This mode of operation allows any colors Y, M and C to be printed on any single point on the recording paper. By superimposing the colors Y and M, a dot can be printed in red. Similarly, dots can be printed in blue and green by superimposing the colors M and C, and Y and C, respectively. Further, a black dot can be printed by superimposing the colors Y, M and C. Accordingly, seven colors can be expressed simply by scanning the print head over the recording paper in a single stroke.

FIG. 14 shows another embodiment of a multicolor printing operation in which dots 17Y, 17M and 17Y in the colors Y, M and C, respectively, are printed so as not to be superimposed, and three adjacent dots in the colors Y, M and C are regarded as a single picture element or pixel. With this arrangement, seven colors can be printed by suitably combining the dots in Y, M and C in the pixels. It is important for clear hue expression with this multicolor printing system that wires of small diameter be used for printing small dots to reduce the diameter of pixels.

As aforenoted, where ink ribbons are employed, the smalldiameter wires tend to pierce through interstices in the ribbon fabric, resulting in trouble with the ink ribbon. However, there is no such trouble experienced with the wire dot printer utilizing different colored inks. The smaller wire diameter contributes to improved printing quality and is capable of easy hue expression with dot matrices.

In addition, multicolor printers using ink ribbons are disadvantageous in that the ink density on the ribbon varies due to the differences between frequencies of use of different color strips on the ribbon, resulting in unbalanced colors being printed. With the wire dot printer utilizing different colored inks, liquid inks are directly applied to the wire ends so that no change occurs in the color density and hence printed colors are balanced even after printing for a long period of time.

A cleaning device in the wire dot printer of the present invention for removing paper dust and ink deposited on the distal end of the print head for proper multicolor printing will now be described.

Figure 15:
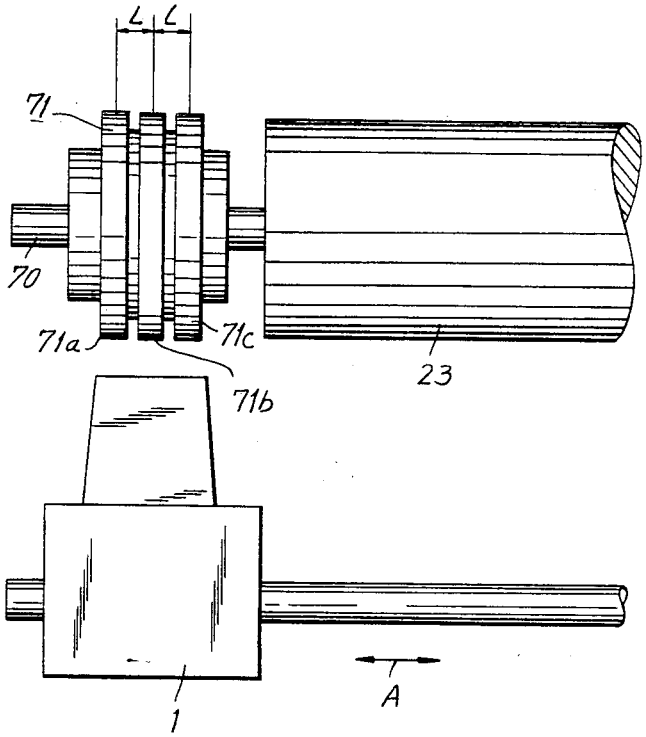
FIG. 15 is a fragmentary plan view of a wire dot printer employing a cleaning mechanism according to the present invention.
Figure 16:
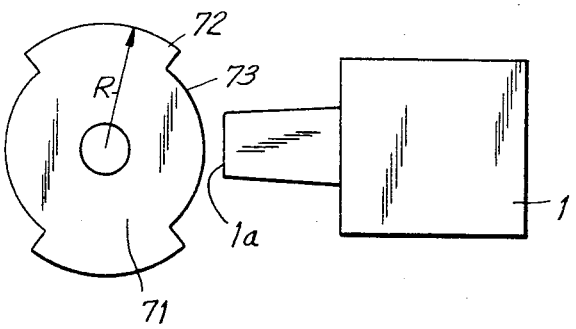
FIG. 16 is a side elevational view of the wire dot printer depicted in FIG. 15.

As shown in FIG. 13, the print head for multicolor printing has wire arrays 14Y, 14M and 14C containing equal numbers of wires and spaced at equal intervals L. FIG. 15 fragmentarily shows a printer having a cleaning device of the present invention, and FIG. 16 is a side elevational view of the printer shown in FIG. 15. Print head 1 is reciprocably moved in the directions of arrows A by a drive mechanism for printing on a sheet of recording paper against a platen 23. A cleaning member 71 includes an integral body having a stepped configuration as illustrated in FIG. 15 defining cleaning portions 71*a*, 71*b* and 71*c* having centers spaced a distance L equal to the interval L at which the wire arrays are spaced. Cleaning member 71 is rotatably mounted on a platen shaft 70 in coaxial relation with platen 23. Cleaning member 71 is made of a porous, water-absorbent, resilient spongy material such as a foamed polyvinyl formal resin. The density of minute holes in cleaning member 71 is rendered progressively higher from the outer periphery toward the center of the cleaning member 71 so that the water absorption capability becomes stronger toward the center of the cleaning member 71. This enables inks to flow more easily toward the center of cleaning member 71 and prevents inks from mixing at the outer periphery more reliably. Cleaning member 71 is of an integral construction and can be rotated independently of the platen motion 23 by the drive mechanism which may comprise a motor, a solenoid, or the like.

As shown in FIG. 16, the outer peripheral configuration of cleaning member 71 comprises projections 72 held in contact with a distal end 1*a* of print head 1 and alternate recesses 73 held out of engagement with the distal end 1a of the print head 1. Cleaning member 71 has a radius R at projections 72 which is slightly larger than the distance between the center of platen 23 and the distal end 1*a* of the print head 1 by an interval which may range from 0.1 to 0.2 mm, for example. Thus, distal end 1a of print head 1 is brought into complete contact with cleaning member 71 at the projections 72. Cleaning member 71 is kept out of contact with the print head end 1*a* at recesses 73.

Operation of the cleaning device thus constructed will now be described. After print head 1 has printed desired characters and symbols while reciprocably moving in the direction of arrows A of FIG. 15, print head 1 returns to and stops in its home position in which cleaning portions 71*a*, 71*b* and 71*c* confront wire arrays 14Y, 14M and 14C, respectively. At this time, cleaning member 71 is stopped with one of the recesses 73 facing distal end 1a of the print head 1 as illustrated in FIG. 16. Then, cleaning member 71 is rotated by a drive mechanism to cause one of projections 72 to wipe print head end 1a to remove paper dust, ink, and other foreign matter therefrom. When the next recess 73 confronts print head end 1*a*, the rotation of the cleaning member 71 is stopped and print head 1 is actuated for a next cycle of printing operation.

By thus wiping print head end 1a with rotating cleaning member 71 while cleaning portions 71*a*, 71*b* and 71*c* confront wire arrays 14Y, 14M and 14C, respectively, the portions of print head end 1*a* respectively for the different inks can be cleaned independently, so that no ink mixture will take place on the print head.

Figure 17:
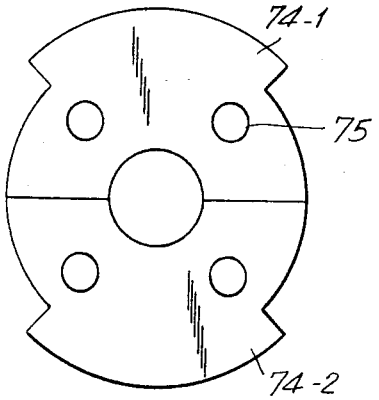
FIG. 17 is a side elevational view of a cleaning device according to another embodiment of the present invention.
Figure 18:
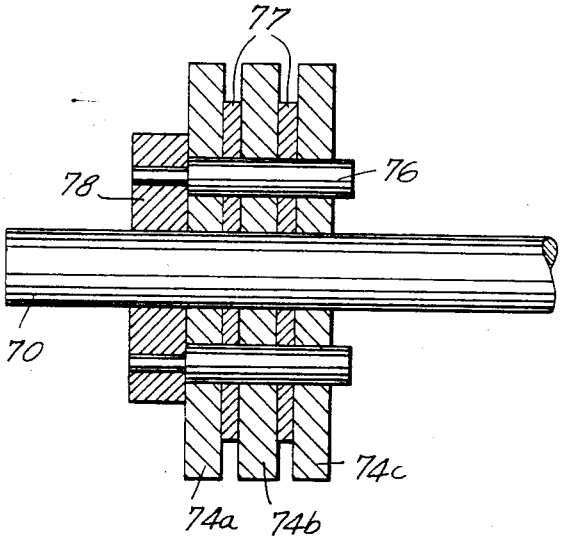
FIG. 18 is a cross-sectional view of the cleaning device of FIG. 17 shown mounted on a platen shaft.

FIG. 17 is a side elevational view of a cleaning member 74 according to another embodiment of the present invention, and FIG. 18 is a cross-sectional view of the cleaning member of FIG. 17 shown mounted on a platen shaft 70. Cleaning member 74 includes three cleaning portions 74*a*, 74*b* and 74*c* corresponding to the different ink colors used. The outer peripheral shape of cleaning member 74 is the same as that of the cleaning member illustrated in FIG. 16. However, as shown in FIG. 17, the cleaning member 74 is divided into two cleaning member portions 74-1 and 74-2 having attachment holes 75. As shown in FIG. 18, cleaning member 74 is rotatably mounted coaxially on platen shaft 70 with attachment pins 76 fixed to an attachment plate 78 inserted through the attachment holes 75. Cleaning portions 74*a*, 74*b* and 74*c* are divided by partitions 77 for preventing ink mixture between the cleaning portions. With cleaning member 74 divided into the cleaning member portions, it can easily be attached and detached for replacement when cleaning member 74 is smeared with inks, damaged or worn out. Partitions 77 can prevent inks from being mixed together between the cleaning portions more reliably.

FIG. 19 illustrates a cleaning member according to still another embodiment of the present invention. Although cleaning member 79 has the same outer peripheral shape as that of the cleaning members of the previous embodiments described above, it is mounted positionally adjustably on a frame 80 out of axial alignment with platen shaft 70 and independently thereof. Cleaning member 79 is rotatable in the direction of arrows B. With this arrangement, the distance between cleaning member 79 and the distal end 1*a* of the print head 1 can easily be adjusted. Cleaning member 79 can be removed or attached more simply for easy replacement.

Cleaning member 79 may be of an integral construction with grooves between adjacent cleaning portions as shown in FIG. 15, or may have as many cleaning portions as there are colors to be printed with partitions interposed therebetween.

FIG. 20 is a timing chart showing operation of the cleaning device of the present invention. With reference to the embodiment of FIG. 15, the sheet of recording paper is fed along by each paper feed signal, and print head 1 is reciprocably moved by each carriage feed signal. After print head 1 has returned to its home position, the cleaning member is rotated by a cleaning signal to clean the distal end 1a of print head 1.

It is not necessary to clean the distal end of the print head each time a line is printed on the recording paper. A single cleaning operation suffices each time a single page of recording paper has been printed. Assuming that a single page contains n lines, a single cleaning signal for cleaning the print head is issued for n-time productions of a carriage feed signal and a subsequent paper feed signal. Cleaning member 71 is hence of a longer service life, and stable printing operation for a prolonged period of time is ensured.

The cleaning signal can also be generated by manual operation. As long as print head 1 is stopped in the home position with cleaning portions 71*a*, 71*b* and 71*c* facing the wire arrays 14Y, 14M and 14C, respectively, a cleaning signal can be issued as desired to rotate cleaning member 71 for cleaning the distal end 1 of print head 1.

While in the foregoing embodiments the wire arrays on the print head are held in confronting relation to the cleaning portions when the print head is in the home position, the home position may not necessarily be aligned with the cleaning member. Instead, the print head may be moved to bring its wire arrays into confronting relation to the cleaning portions of the cleaning member in response to a cleaning signal, and after the print head has come to a stop, the cleaning member may be rotated for cleaning operation.

In accordance with the present invention as described in detail herein, a wire dot printer capable of printing in different colors without color mixing during printing or cleaning is provided. The wire dot printer produces a beautiful, clear and fine printing on a desired recording paper.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A wire dot printer for multicolor printing with inks of different colors comprising a plurality of wires for carrying said inks on the ends thereof, ink applicator means for housing said plurality of wires in separate groups and for supplying one color of ink to each said respective group of wires, each said group of wires carrying a single color of ink, and ink supply means for supplying said inks of different colors to said ink applicator means, said wires being displaceable between an inking position where said ink is applied to the ends of said wires and a printing position where said wires extend out of said ink applicator means where said ink carried by the ends of said wires can be printed to effect multicolor printing, each group of wire ends being arranged in separate arrays to permit selective color printing of said different colors of ink, each group of wire ends being arranged in a vertical array, each said array being spaced from adjacent arrays by a predetermined distance, and partition means extending intermediate each adjacent separate group of wires for preventing an ink color from one group of wires from being mixed with a different ink color from another group of wires, said partition means extending off said ink applicator means in the direction of said wires to a position essentially adjacent said wire printing position.

2. The wire dot printer as claimed in claim 1, wherein said ink applicator means includes a separate ink applicator for each said group of wires, each said separate ink applicator supplying one color of ink to its associated groups of wires.

3. The wire dot printer as claimed in claim 2, wherein said ink supply means supplies one color of ink to each said ink applicator.

4. The wire dot printer as claimed in claim 2, wherein each said ink applicator includes an ink supply and discharge guide to which said ink is supplied by said ink supply means and an ink application guide for receiving ink from said ink supply and discharge guide and for applying said ink to the ends of said wires, said ends of said wires carrying said ink to effect printing.

5. The wire dot printer as claimed in claim 4, wherein each said ink applicator further includes a wire guide means for guiding said wires between said inking and printing positions.

6. The wire dot printer as claimed in claim 5, wherein an ink passage is defined intermediate said ink supply and discharge guide and said wire guide, said ink passage including a bypass portion which permits ink to flow therethrough and a capillary region which draws ink from said bypass portion and supplies ink to said wire ends.

7. The wire dot printer as claimed in claim 1, wherein said partition means includes a partition wall between each adjacent group of wires which extends along the length of said wires and off of said ink applicator means in the direction of said wires to a position where the ends of said partition walls lie essentially adjacent said wire printing position for separating said respective groups of wires from each other to prevent ink from one group of wires from mixing with a different color ink from another group of wires.

8. The wire dot printer as claimed in claim 2, further comprising a frame, a carriage slideably supported on said frame, a print head mounted on said carriage for displacement therewith, said ink applicators and said wires being supported on said print head, said ink supply means including ink tank means supported on said carriage for separately storing said inks of different colors and tube means for connecting said ink tank means to said ink applicators to permit said inks in said ink tank means to be supplied to said wires.

9. The wire dot printer as claimed in claim 8, wherein said ink supply means includes a tube connector supported on said carriage and coupled to said tube means and an ink supply guide means coupled intermediate said tube connector and said ink applicators for guiding said ink to said wires.

10. The wire dot printer as claimed in claim 9, wherein said tube connector includes O-rings for coupling said tube connector to said ink applicators.

11. A wire dot printer for multicolor printing with fluid inks of different colors in which printing is performed with said inks adhereing to the ends of printing wires for direct transfer of said adhering ink to a recording medium upon impact therewith comprising a plurality of printing wires having ends on which said inks are carried, a print head supporting said wires, said print head having a distal end where the ends of said wires are positioned, said wires being divided into separate groups, each said group of wires corresponding to one color of said ink, each said group of wires being arranged in an array at the distal end of said print head, and partition means extending intermediate said adjacent separate groups of wires along the length of said wires for preventing one color ink from a group of wires from mixing with another color ink from another group of wires, said partition means extending off of said print head towards said recording medium to a position essentially defined where said wires impact said recording medium.

12. The wire dot printer as claimed in claim 11, further comprising a carriage means for supporting said print head, a guide block supported on said carriage, said guide block having a plurality of compartments extending longitudinally of said wires, and partition means for separating each said compartment from adjacent compartments, each said group of wires being separately disposed in one of said compartments.

13. The wire dot printer as claimed in claim 12, further comprising driver means for selectively projecting said wires between an inking position and a printing position.

14. The wire dot printer as claimed in claim 12, wherein said guide block includes an ink supply and discharge guide for directing each color of ink to its associated group of wires.

15. The wire dot printer as claimed in claim 14, further comprising a plurality of ink tanks each holding an ink of a different color, tube means for placing said ink supply and discharge guide in fluid communication with the inks in said ink tanks, and pump means for pumping said respective different colors of ink to its associated group of wires.

16. The wire dot printer as claimed in claim 14, wherein the distal end of said print head includes said partition means for isolating each group of wires from adjacent groups of wires.

17. The wire dot printer as claimed in claim 11, further comprising cleaning means for separately cleaning each portion of the distal end of said print head corresponding to a separate group of wires.

18. The wire dot printer as claimed in claim 17, wherein said cleaning means includes a cleaning member having projections and recesses disposed intermediate each said projection, and means for rotating said cleaning member between a first position where said projections contact the distal end of said print head for cleaning said print head and a second position where said recesses face the distal end of said print head and are out of contact therewith.

19. The wire dot printer as claimed in claim 18, wherein said cleaning member includes a cleaning portion for each said group of wires, each said cleaning portion being isolated from adjacent cleaning portions to prevent mixing of said ink colors when cleaned from said print head.

20. The wire dot printer as claimed in claim 19, wherein each said cleaning portion includes a projection and a recess, said projections each cleaning a different group of wires when rotated to said first position.

21. The wire dot printer as claimed in claim 20, wherein each said cleaning portion includes separate cleaning sections which are coupled together to facilitate separate attachment and removal of said cleaning portions from said cleaning means.

22. The wire dot printer as claimed in claim 17, further comprising platen means facing said print head and a platen shaft for rotating said platen means, said cleaning means being mounted coaxially on said platen shaft.

23. The wire dot printer as claimed in claim 17, further comprising platen means facing said print head and a platen shaft for rotating said platen means, said cleaning means being mounted out of coaxial relation with said platen shaft for independent rotation.

24. A wire dot printer for printing dots of different colors on a recording medium by means of fluid ink adhering to the ends of printing wires which selectively deposit the ink on the recording medium comprising a print head having a distal end which reciprocally scans along said recording medium, a plurality of wires supported on said print head for carrying inks of different colors to be printed, the ends of said wires being positioned on the distal end of said print head, cleaning means for cleaning the distal end of said print head, and cleaning drive means for selectively producing cleaning signals, said cleaning means having an outer peripheral configuration defining alternating projections and recesses, said cleaning means being rotatable, said print head being out of contact with said recesses when one said recess faces said print head, one said projection contacting the distal end of said print head for cleaning thereof when one said projection faces said print head, one said recess facing said print head during reciprocal scanning of said print head, said cleaning means being rotated and one said projection wiping said distal end of said print head when said print head stops and faces said cleaning means when said cleaning drive means issues a cleaning signal, and after said distal end of said print head is wiped, said cleaning means rotating to position a recess to face said print head, said wires being separated into groups, each said group of wires corresponding to a single color of ink, said cleaning means including a cleaning portion for each said group of wires, each said cleaning portion including alternating projections and recesses, each said cleaning portion being isolated from adjacent cleaning portions to prevent mixing of said ink colors when cleaned from said print head.

25. The wire dot printer as claimed in claim 24, wherein each said cleaning portion includes a projection and a recess, said projections each cleaning a different group of wires when rotated to said first position.

26. The wire dot printer as claimed in claim 24, further comprising platen means facing said print head and a platen shaft for rotating said platen means, said cleaning means being mounted coaxially on said platen shaft.

27. The wire dot printer as claimed in claim 24, further comprising platen means facing said print head and a platen shaft for rotating said platen means, said cleaning means being mounted out of coaxial relation with said platen shaft for independent rotation.

* * * * *